US005914733A

United States Patent [19]

Sato et al.

[11] Patent Number: 5,914,733

[45] Date of Patent: Jun. 22, 1999

[54] INK JET PRINTING DEVICE

[75] Inventors: Hiroyuki Sato; Ryusuke Morita; Hitoshi Yauchi, all of Tokyo, Japan

[73] Assignee: Fuji Photo Film Co., Ltd., Japan

[21] Appl. No.: 08/714,866

[22] Filed: Sep. 17, 1996

[30] Foreign Application Priority Data

Sep. 21, 1995 [JP] Japan ..... 7-243319

[51] Int. Cl.[6] ..... B41J 2/165; B41J 29/393

[52] U.S. Cl. ..... 347/23; 347/19

[58] Field of Search ..... 347/7, 23, 30, 347/14, 19; 73/32 R, 6, 19

[56] References Cited

U.S. PATENT DOCUMENTS 5,162,817 11/1992 Tajika et al. ..... 347/86

FOREIGN PATENT DOCUMENTS 0412459 8/1990 European Pat. Off. .
0440261 2/1991 European Pat. Off. .
0509747 4/1992 European Pat. Off. .
0664216 1/1995 European Pat. Off. .
5-270006 10/1993 Japan ..... B41J 2/175

OTHER PUBLICATIONS

Junichi, "Ink Jet Recorder", Patent Abstracts of Japan, vol. 095, No. 008, Sep. 29, 1995, JP 07 112531 A (Canon Inc.), May 2, 1995 (Abstract).

Takatoshi, "Ink Jet Recorder", Patent Abstracts of Japan, vol. 015, No. 416 (M–1172), Oct. 23, 1991, JP 03 176160 A (Hitachi Ltd.), Jul. 31, 1991 (Abstract).

*Primary Examiner*—N. Le
*Assistant Examiner*—Thien Tran

[57] ABSTRACT

An ink jet head which enables using plural types of ink in the head to accommodate varying types of paper or objects to be imprinted. The single ink jet head includes plural cartridges which are selected in accordance with the property of the medium which is imprinted or the ink finish which is desired. The ink jet head includes a discharge element which is excitable under a controller to comply with the characteristics of the type of ink sensed by detecting the electrical conductivity of the ink.

1 Claim, 7 Drawing Sheets

(A)

(B)

INK JET PRINTING DEVICE

FIELD OF THE INVENTION

The present invention relates to an ink jet printing device which performs a printing operation by discharging an ink out through the nozzle toward the printing paper and more particularly to an ink jet printing device which is capable of performing the printing operation respectively for plural types of ink.

PRIOR ART

Nowadays, it has become possible for everybody to easily perform image printings thanks to the progress of computers and printing devices. Among the characteristic examples of printing devices is known an electrophotographic type, an ink jet type or a thermal transfer type. Particularly, the ink jet type is relatively low cost in installing, easier to make it large sized and capable of performing printing operations without contacting the printing medium such that it enjoys a wide application for not only office uses but also for forming outdoor advertisement images or for production management of industrial products.

In general, the ink jet printing device is constructed in such a way as it comprises an ink jet head formed with ink passages therein, each ink passage having a leading end portion thereof in the form of nozzles; discharge elements arranged in said ink jet head to discharge ink filled in said ink passages out through said nozzle; and excitation control means for energizing said discharge element. In such a structure, the ink which can be used is limited to only one type with the result that said only one type of ink is used for a particular ink jet printing device. In order to exchange inks, the ink theretofore filled is required to be drawn out of the ink passages. This procedure is followed for preventing the ink jet head from otherwise becoming incapable of discharging ink due to closure of the nozzles with ink which sticks thereto, is dried or collects sediment as a result of mixing of and chemical reactions between different types of ink.

On the other hand, the color ink jet printing device requires the preparation of respective separate ink jet heads in correspondence with the four color inks including Cyan (Dark Blue: C), Magenta (Brilliant Crimson: M), Yellow (Yellow : Y) and Black (Black: B). Some device uses further more types of ink with different densities, corresponding to which separate printing heads are provided. In this way, the conventional ink jet printing devices are constructed with one ink jet head to be used correspondingly for one type of ink.

In this connection, coloring agents to be used by the aforementioned ink jet printing device fall in two general categories including a dye type and a pigment type. While the dye type coloring agent is superior in clearness to the pigment type, the dye type is vulnerable to the attack of water or light. On the other hand, the pigment type coloring agent is inferior in clearness to dye type but it is resistant to water or light.

Further, some type of printing paper blots easily and some not. The easily blotting printing paper allows ink to spread so quickly that it invites less ink consumption than the paper which is resistant to blotting. However, the quick spread of ink lessens the brightness of color printing in the former type as compared to the latter.

In this way, inks and printing papers have various characteristics of their own, respectively. Therefore, if it is possible to use a variety of inks and printing papers for a single ink jet printing device, it is expected that a variety of printing operations should be done by conducting various printing condition settings.

Actually, however, the ink jet head of the ink jet printing device is, in general, capable of using only one type of ink in a one-to-one correspondence while there is developed no single ink jet head which can use several types of ink.

As an example of a device which introduces a substitute solvent into ink passages of the ink jet head in addition to ink, there is a bubble removing device as described in Japanese Patent Laid-open Publication No. 55-150373. The bubble removing device disclosed therein sucks ink into the ink passages when bubbles are formed in the ink passages until they are discharged forcibly while a substitute solvent fills the ink passages in its place. Thereafter, ink is further introduced into the ink passages filled with said substitute solvent such that said ink in turn is substituted for the substitute ink. An electromagnetic pump is used for this series of substitution action. Since such lower alcohol as has a weak surface tension is used as said substitution solvent, said substitution solvent will fill every corner of the ink passages even if the ink passages are filled with air after the ink has been drawn out of the ink passages. Many types of ink used for the ink jet printing device have a surface tension of about 40 to 60 dyne/cm and a viscosity of about 2 to 6 cP. The inks having such a value of surface tension can fail to completely fill the ink passages and help create an air layer at the time of the filling operation. To prevent this phenomenon from happening, a substitution solvent having a surface tension of about 20 dyne/cm is used. Since such substitution solvent is not for the printing purpose, the substitution conditions are extremely simple.

In this way, the use of a substitution solvent having a weak surface tension in place of ink is practiced at the time of removing bubbles in the ink passage. Given the situation, it is difficult to exchange inks for a single ink jet head incorporating different types of ink without forming bubbles in the ink passages even nowadays when it is possible to avoid collection of sediment as a result of mixing different types of ink. The present invention is aimed at overcoming the various problems arising from operations for exchanging various types of ink by reviewing the aforementioned problems and providing an ink jet printing device which is capable of using plural types of ink by means of a single ink jet head for the purpose of handling different types of ink in accordance with objects and increasingly varying paper types.

SUMMARY OF THE INVENTION

In order to achieve the aforementioned object, the ink jet printing device is characterized in that an ink exchange mechanism is provided such that plural types of ink are used for a single ink jet head while the energy control means are constructed such that the drive conditions of the discharge element may be switched in accordance with the types of the ink. By adopting such structure, it is possible to select the type of ink to be used in accordance with the paper characteristics and the desired print finish.

The present invention is further characterized in that said ink exchange mechanism includes a non-discharge type restoring mechanism to regenerate said ink jet head by admitting ink into said ink jet head and to perform an ink type switching action.

The present invention is still further characterized in that said non-discharge type restoring mechanism is adapted to introduce a different type of ink rearwardly of the ink theretofore filled.

The present invention is still further characterized by including an ink type detection means arranged for detecting the type of ink in accordance with the electrical conductivity of the filled ink.

DETAILED DESCRIPTION OF EMBODIMENTS

Figure 1:
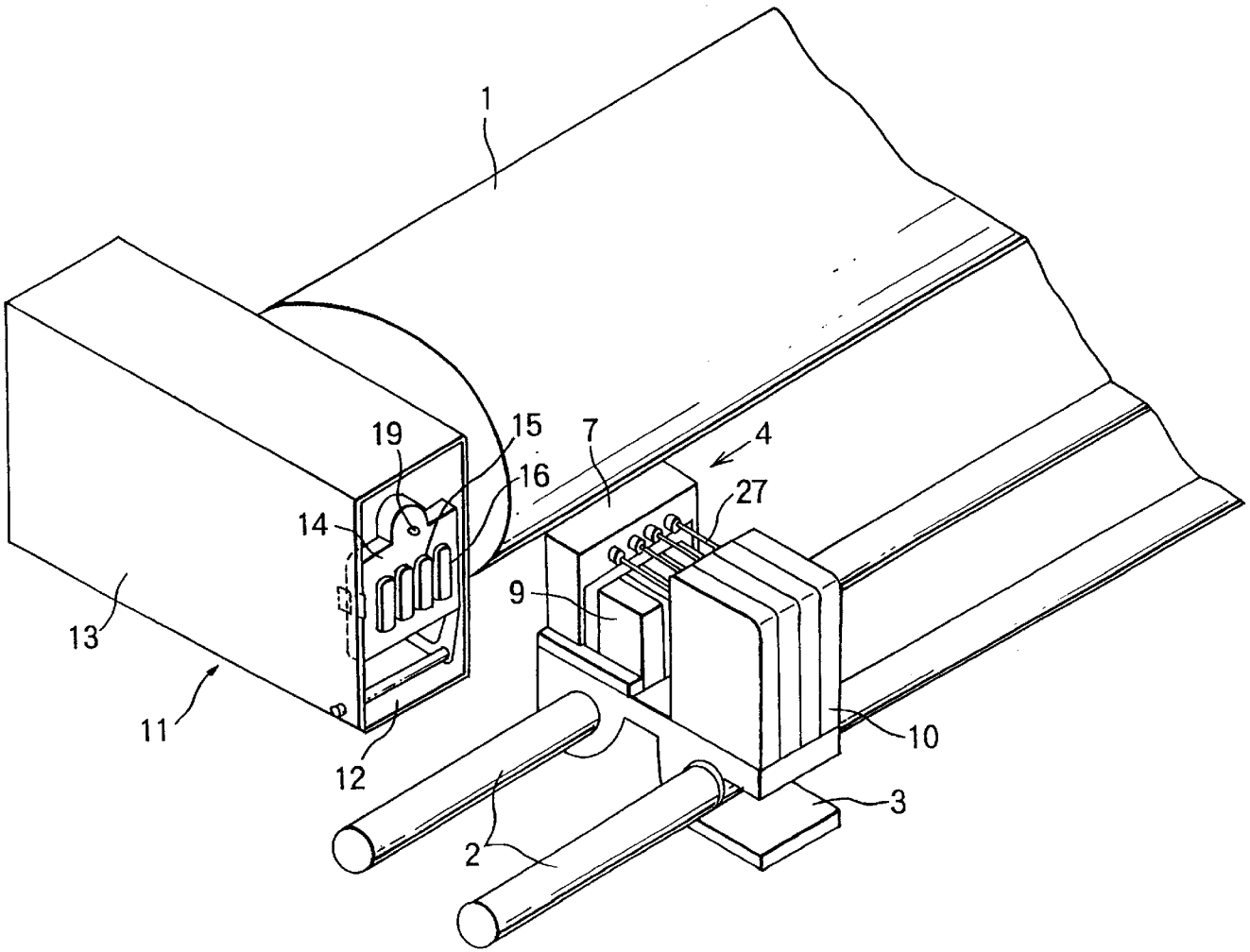
FIG. 1 is a perspective view showing one embodiment of the present invention.
Figure 2:
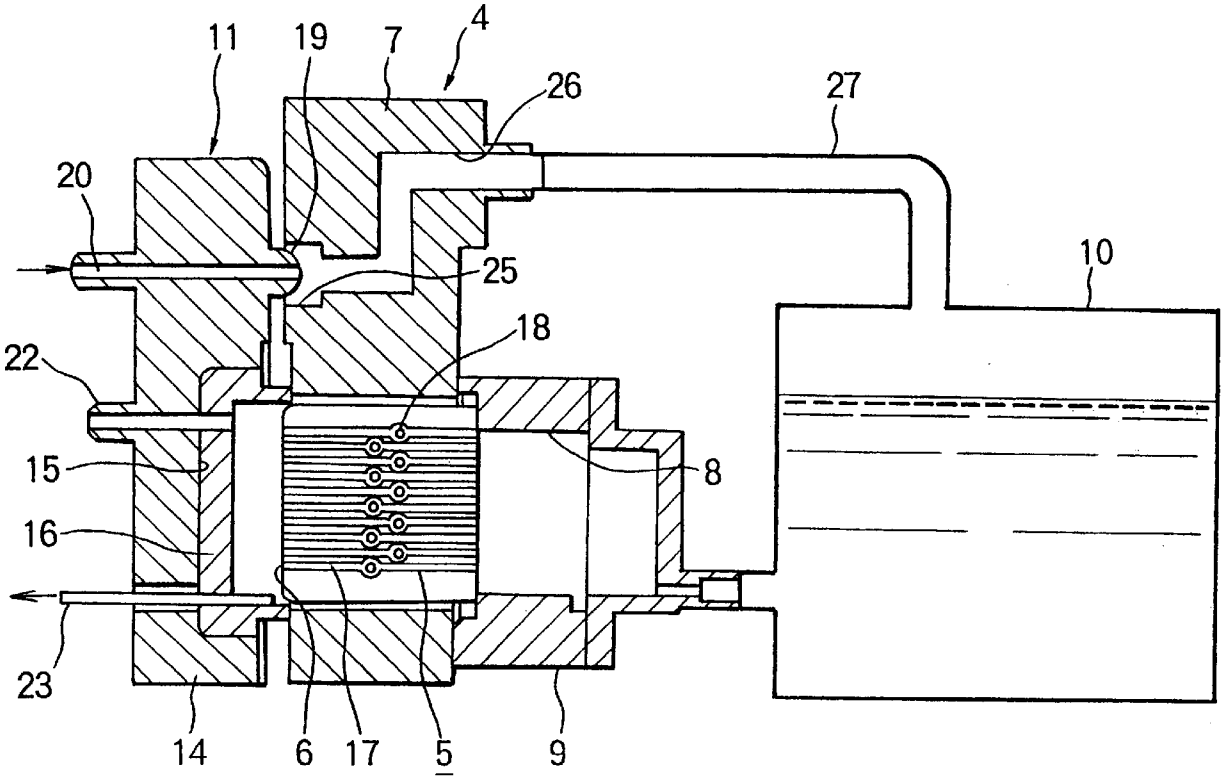
FIG. 2 is a vertical cross section of FIG. 1.

FIG. 1 and FIG. 2 show the principal portions of the embodiment of the invention relating to the ink jet printing. As shown in FIG. 1, a cylindrical platen 1 is provided with a pair of carriage shafts 2 being arranged in front of and in parallel with the axis of said platen 1. Carriage 3 is provided to shuttle along said carriage shafts 2. Said carriage 3 carries ink jet unit 4 thereon capable of performing a full color printing operation (FIG. 1).

Said ink jet unit 4 carries four ink jet heads 5 (FIG. 2), which correspond to the four color inks for full color printing, in a facing relation to said platen 1. Each ink jet head 5 has a plurality of nozzles 6 (FIG. 2) vertically arranged in registry with each other in facing relation to said platen 1. Said ink jet head 5 is secured to a head mount 7 supported by said carriage 3.

Said carriage 3 further carries an inlet member 9 rearwardly of each ink jet head 5, said inlet member 9 accommodating an auxiliary tank 8 functioning as a buffer tank to communicate with each nozzle 6 provided in said ink jet head 5. Each inlet member 9 provides communication with an ink cartridge 10 containing an ink of corresponding color, said cartridge 10 being removably loaded on said carriage 3.

At one longitudinal end of the platen 1 is provided a pump unit 11 functioning as a non-discharge type restoring mechanism for covering up the nozzles 6 to prevent ink in the nozzles from being dried while not in use or removing bubbles formed in the nozzle 6 or foreign matters clogging the nozzles 6. In this embodiment, said pump unit 11 constitutes an ink exchange mechanism. Said pump unit 11 includes a casing 13 formed with an opening 12 in facing relation with said carriage 3 and a cap body 14 accommodated within said opening 12 of said casing 13 in such a manner as to be movable toward and away from said ink jet unit 4. Said cap body 14 is formed with a plurality of vertical openings 15 to cover up the respective ink jet heads 5. The inside of each opening 15 is lined with a rubber liner 16 therein. Said liner 16 is adapted to protrude outwardly from the inside periphery of said opening 15 to be air tightly press fitted against the outer periphery of each ink jet head 5.

Further, said ink jet heads 5 are formed with a plurality of ink passages 17 in communication with the respective nozzles 6 and vertically in registry with each other. Each ink passage 17 is provided with for instance a piezoelectricity element 18 as a discharge element for discharging ink from the nozzle 6 at the tip of said ink passage 17.

On the other hand, the front face of the upper portion of the cap body 14 of the pump unit 11 is formed with a substantially semi-spherical protuberance 19 projecting therefrom. A pressurized air passage 20 communicating with the tip of said protuberance 19 is formed through the cap body 14 as far as the back thereof. A pump or other pressurizing means (not shown) is connected to said pressure air passage 20. Further, each opening 15 of said cap body 14 is in communication with the atmosphere by way of a release valve (not shown) through a communication passage 22. Further, waste liquid pipes 23 are connected to the respective openings 15 in the cap body 14. Each exhaust fluid pipe 23 is connected to a pump-like sucking means (not shown), the ink sucked by said sucking means being led to an exhaust fluid tank (not shown) for storage.

On the other hand, the upper portion of the head mount 7 facing the pump unit 11 is formed with a single pressurized air passage 25 which is brought into communication with said pressurized air passage 20 as a result of said protuberance nozzle touching when the pump unit 11 covers up ink jet unit 4. Said pressurized air passage 25 branches off into four branch passages 26 corresponding to the number of the ink cartridges 10. There are connected air pipes 27 at the tip ends of the respective branch passages 26 in communication with an upper inside of the respective ink cartridges 10.

Figure 3:
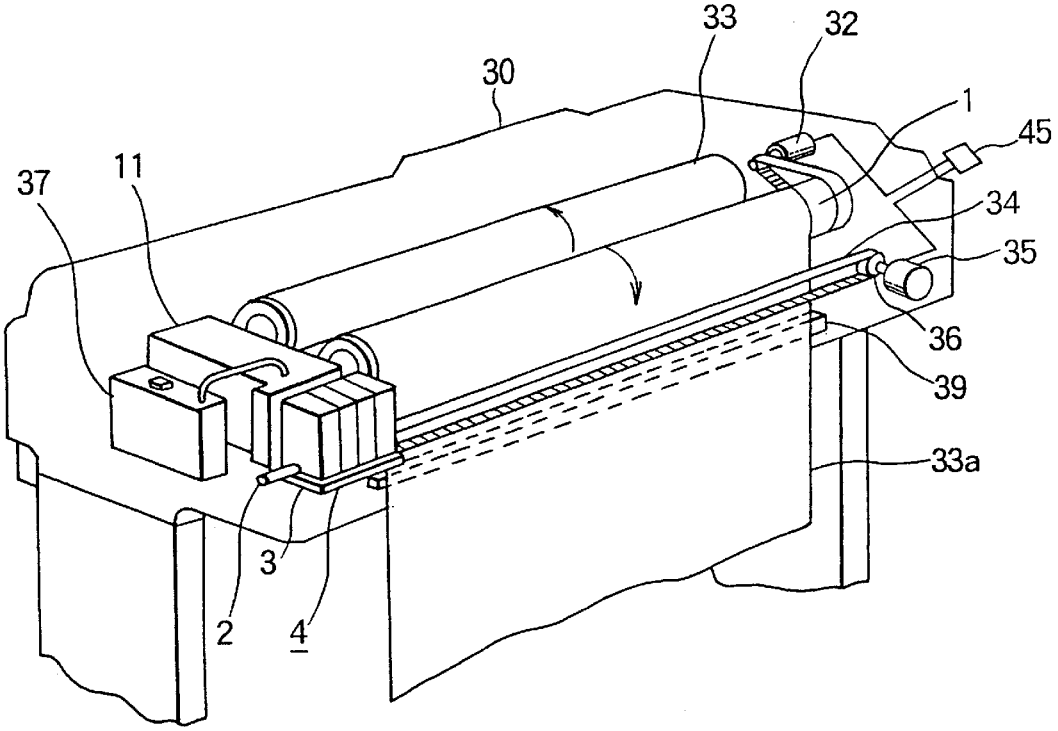
FIG. 3 is a perspective view of the interior of FIG. 1.
Figure 4:
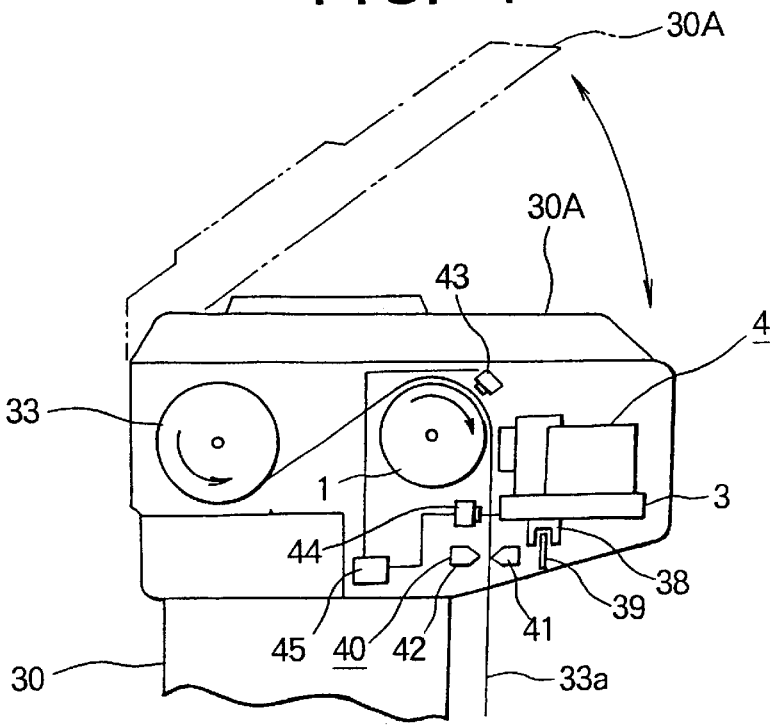
FIG. 4 is a side elevation of FIG. 3.

The general ink jet printing device is shown in FIG. 3 and FIG. 4. The cylindrical platen 1 having an axis horizontally extending is rotatably provided within the housing 30 of said ink jet printing device. At one end of said platen 1 is supported a driven pulley (not shown), around which a belt 32 is passed to be driven by a reversible first motor 31. Therefore, said platen 1 is selectively driven in a regular paper feed direction or a reverse paper feed direction by said reversible first motor 31.

Within said housing 30 rearwardly of said platen 1, a paper roll 33 having an axis parallel to said platen 1 is loaded. Said paper roll 33 is rotated counterclockwise in FIG. 3 such that a roll paper 33*a* is payed out to be stretched around the top of the platen 1.

Within said housing 30, the ink jet unit 4 is positioned in facing relation to said platen 1 to shuttle in a parallel direction to the axis of said platen 1. The carriage 3 of said ink jet unit 4 is provided with a plurality of ink jet heads (not shown) which discharge the filled ink in the direction of said platen 1. A driving belt 34 is connected to said ink jet unit 4, said driving belt 34 being stretched around the periphery of a driving pulley 36. Therefore, said ink jet unit 4 driven by said second motor 35 is operated to shuttle along the platen 1 by being guided along the carriage shaft 2 arranged parallelly to the axis of the platen 1. In this connection, the pump unit 11 is arranged near one end of said platen 1 to cover up the nozzle of each ink jet head of the ink jet unit 4 for performing the restoring operation. Also, an exhaust fluid tank 37 is provided in the neighborhood of the pump unit to receive the waste liquid discharged from the nozzles.

A transmission type photointerrupter 38 is attached to the underside of said carriage 3 of the ink jet unit 4 with a space therein extending in the travelling direction of the carriage 3. A linear encoder 39 composed of a thin plate having a number of small holes therein corresponding to the print resolution is extended in said space over the travelling distance of the ink jet unit 4.

Downwardly of said platen 1 and ink jet unit 4 is provided a cutting section 40 composed of a long fixed knife 41 and a long movable knife 42 to cut the roll sheet after being printed.

There is provided a first paper sensor 43 to detect the roll paper 33*a* on the platen 1 in such a way to face the platen 1 upstream of said ink jet unit 4 as taken in the regular feed direction of said roll paper 33*a*. Further, a second paper sensor 44 is provided between the ink jet unit 4 and the cutting section 40 to detect the roll paper passing therebetween. Said respective paper roll sensors 43 and 44 and said respective motors 31 and 35 are connected to a control section 45 of an ink jet printing device such that when signals concerning the roll paper 33*a* is inputted to said control section 45 from the paper sensor 43 and 44, said control section 45 is adapted to drive said motors 31 and 35 in response to the signals.

Referring to FIG. 4 in this connection, a top opening not shown of said housing 30 is covered by an openable cover 30A.

Figure 5:
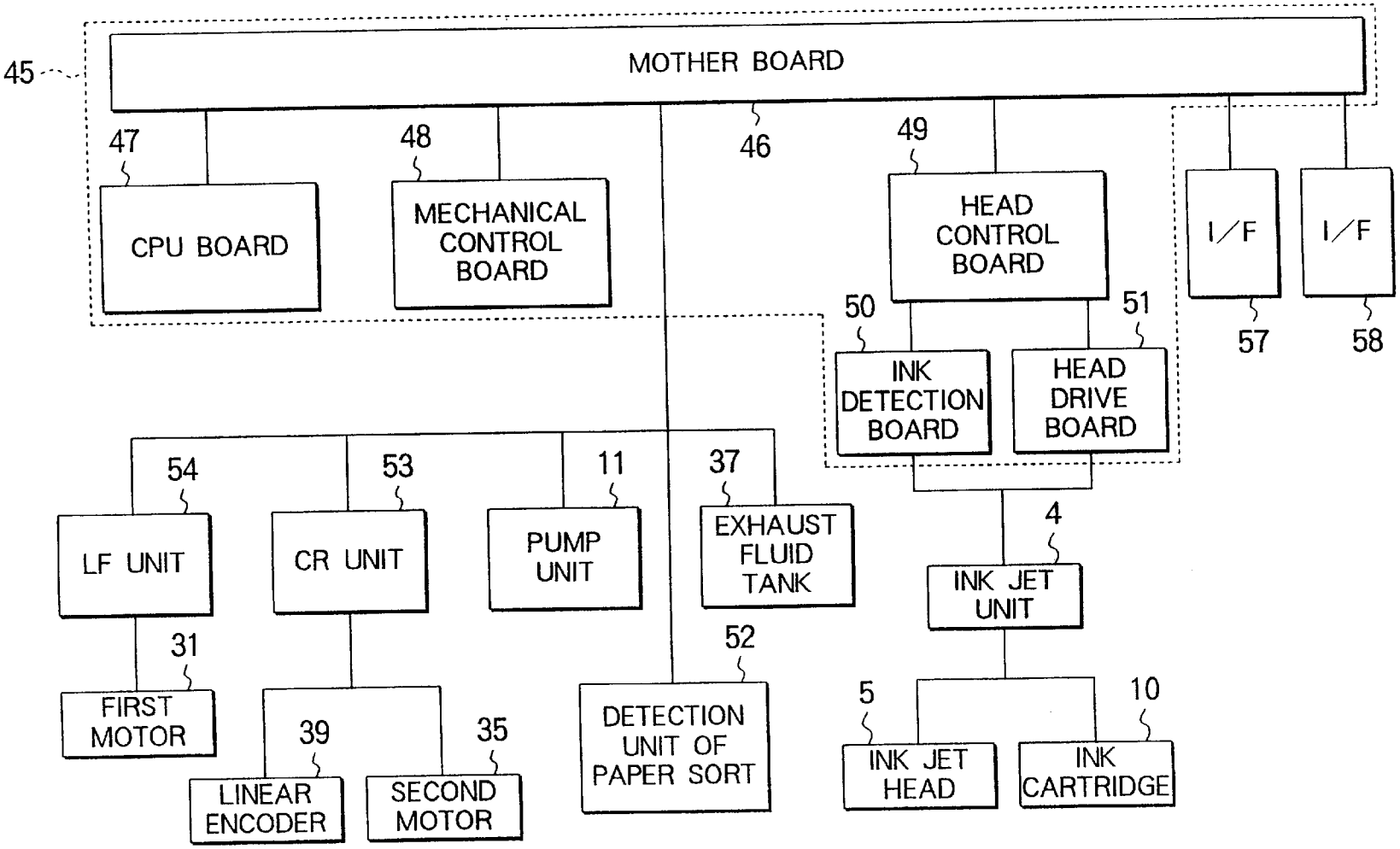
FIG. 5 is a block diagram of the ink jet printing device of FIG. 1 and FIG. 2.

FIG. 5 shows a control block diagram of ink jet printing device including said control section 45.

In FIG. 5, the control section 45 of the general ink jet printing device functioning as the excitation control section is composed of a mother board 46 having a control panel (not shown); a CPU board 47; a mechanical control board 48; a head control board 49; said CPU board 47, said mechanical control board 48 and said head control board 49 being connected to each other by way of said mother board 46; an ink detection board 50 connected to said head control board; said ink detection board 50 and said head drive board 51 being connected to said head control board 49.

Said CPU board 47 accommodates therein a CPU, a ROM, and a RAM; said ROM, among others, has programs for printer action and image processing written therein. Said head control board 49 is connected to the detection unit for paper sort 52, the pump unit 11, the CR unit 53 and the LF unit 54, respectively, to control said detection unit for paper sort 52 for detecting the paper type, said pump unit 11, said CR unit 53 for driving said second motor 35 to move said ink jet unit 4 and said LF unit 54 to drive said first motor 31 for feeding the roll paper 33*a* in response to signal from the CPU of the CPU board 47. Said mechanical control board 48 is provided with drivers (not shown) to drive said detection unit for paper sort 52, said pump unit 11, said CR unit 53 and said LF unit 54. Further, said mechanical control board 48 is adapted to send a signal from said exhaust fluid tank 37 and said detection unit for paper sort 52 to said CPU of said CPU board 47.

Said head control board 49 is constructed such that a ink level detection signal detected by said ink detection board 50 in said ink jet unit 4 is sent to CPU of said CPU board 47 while a logical signal for driving the ink jet heads 5 on the basis of the information from the CPU is formed at said head drive board 51. Said head drive board 51 is adapted to generate, on the basis of said logical signal, a drive signal for driving ink jet heads 5 and corresponding ink cartridges 10 provided in said ink jet unit 4. An explanation for ink exchange operation will be given later on.

Said linear encoder 39 is connected, in parallel with said second motor 35, to said CR unit 53 to output to said CPU of the CPU board 47 a signal corresponding to the number of revolution of said second motor 35 for making constant the travelling speed of said ink jet unit 4. Further, interface units (I/F) 56 and 57 are arranged in said mother board 46 to connect said ink jet printing device to a personal computer or the like.

Next, an explanation for the flow of operations of said ink jet printing device.

When the printer is switched ON, the CPU of the CPU board 47 initializes the respective boards 48, 49, 50, 51 and the respective units 4, 11, 52, 53 and 54, and then, performs recognition work of the type of used paper by means of the signal from said detection unit for paper sort 52, in other words, as to what kind of paper is being used out of the fine type, back print type or the cloth type. Further, said CPU receives a signal which recognizes a signal varying from information as to the type of ink inputted by the operator by operating the setting button and stored as setting information in a non-volatile memory provided in the head control board 49 to the type of the ink supplied for use, or a signal which recognizes which type of ink is being used out of the dye type and the pigment type. Said CPU refers to a data table written in the ROM of the CPU board 23 by means of the data as to the type of detected ink or paper and performs a setting operation regarding drive conditions such as drive voltages and drive frequencies for the ink jet heads adapted to the type of ink and image processing mode adapted to the type of paper.

The drive voltage as a drive condition for said ink jet head 5 adapted for the ink type is set, for example, at 80 volt when the dye type ink is used and at 70 volt when the pigment type ink is used. One example of the drive frequencies 3.0 KHz when the dye type ink is used and 2.7 KHz when the pigment type ink is used. The change in the drive frequency of the ink jet head 5 causes a change in the time required to discharge ink from the ink jet head 5, thus creating the need for adjusting the travelling speed of the ink jet head in relation thereto. In this situation, the determination of a servoconstant for determining the printing speed is effected by said CPU.

With such settings completed, it is possible to perform the desired printing, with the cap body 14 of the pump unit 11 being retracted at the time of printing, by running the carriage 3 carrying the ink jet unit 4 thereon along the platen 1, driving and exciting on the basis of the desired printing signal the piezoelectric elements 18 of the nozzle 6 provided for the printing of the ink jet unit 4, and injecting out through the nozzle 6 onto the paper on the platen 1 the desired ink supplied to the ink passages 17 from the ink cartridges 10 by way of the inlets 9.

On the other hand, the exchange of the ink type is done by driving the second motor 35 to move the carriage 3 carrying the ink jet unit 4 to the reference position (home position) in facing relation to the pump unit 11 constituting the non-discharge type restoring mechanism and exchanging the theretofore used ink cartridge with another kind of cartridge. Thus set, while newly filled another kind of ink liquid in the replaced ink cartridge 10 and the theretofore filled ink liquid contained within the auxiliary tank are to some extent mingled, said another kind of ink is positioned rearwardly of the theretofore filled ink in a continuous way. In this connection, said another kind of ink and the theretofore filled ink are required to be selected from the substances free from the tendency for change in the properties such as color tone, viscosity, surface tension as a result of mixing to such an extent as the color of the obtained image is deteriorated, a poor ink discharge performance is caused due to insufficient ink discharge, a discoloration is seen, or unexpected substances are formed as a result of chemical reaction.

Then, the pump unit 14 is moved toward the ink jet heads 5 for the cap body 14 to cover up the ink jet head 4. When each opening 15 in the cap body 14 provided within the pump unit 11 has covered up the ink jet heads 5, the pressurizing means (not shown) is driven. By the action of said pressurizing means, air is introduced into the upper portion of the ink cartridge 10 filled with the newly filled ink by way of the pressurized air passages 20 and 25, the branch passages 26, and the air pipes 27 such that the inner pressure within the ink cartridges 10 is elevated. The driving action of said pressurizing means is continued as long as the preset time period. Thereafter, the suction means (not shown) is driven to suck the theretofore filled ink in the ink passage 17 into the cap body 14 with the result that the theretofore used ink filling the ink passages 17 and the auxiliary ink tank 8 and the newly filled ink continuously introduced rearwardly thereof are caused to move in this order in the direction of the ink passages 17. The ink exchange is accomplished by driving said suction means (not shown) for such preset time period as to perform the sucking of the ink in a volume somewhat greater than those of the ink passages 17 and the auxiliary tanks 8. Moreover, the theretofore filled ink and the newly filled ink are continuously exchanged with the result that air bubble formation is avoided.

Figure 6:
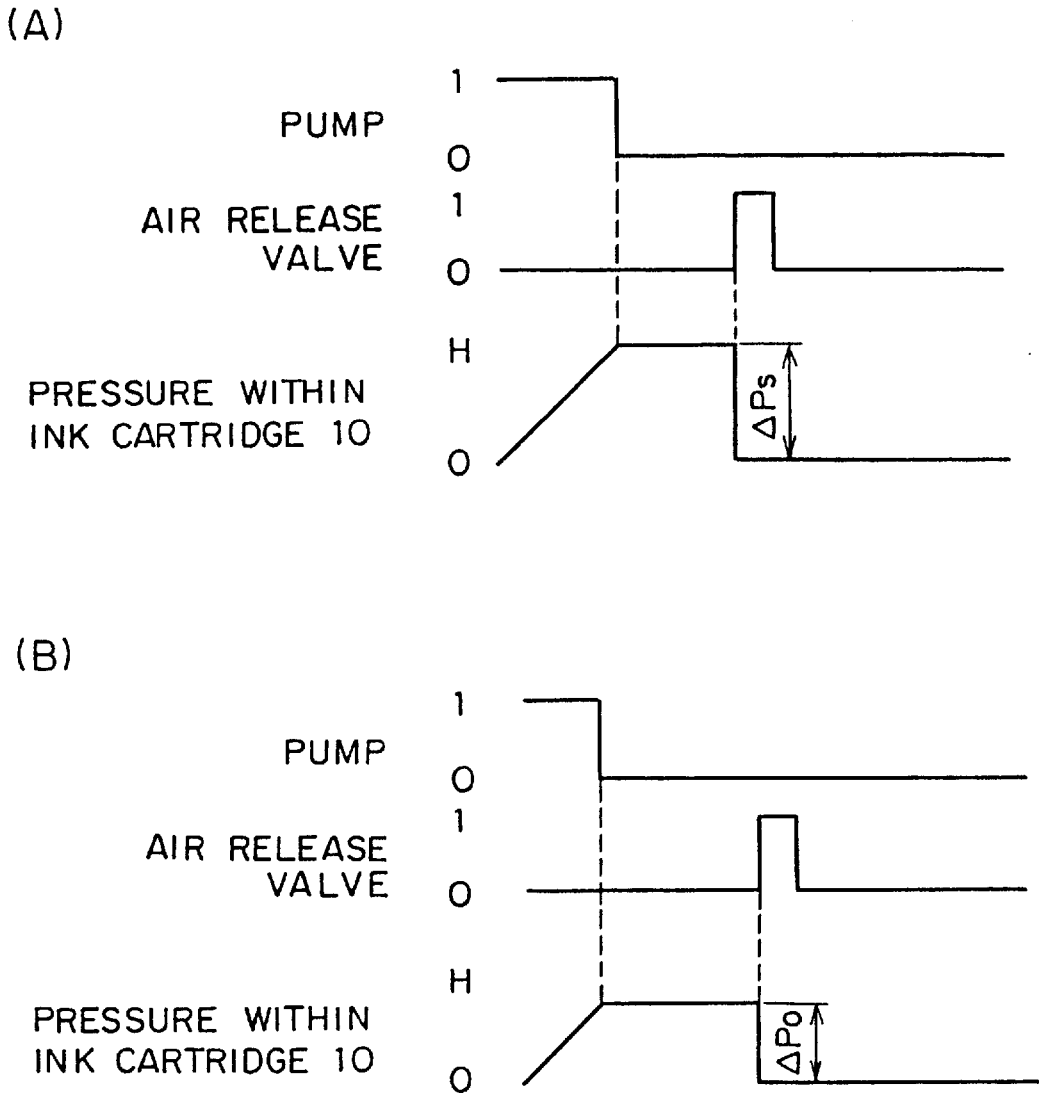
FIGS. 6A and 6B are time charts showing the operation of a pump and valve and the resulting pressure in ink exchange and non-discharge type restoring respectively.

FIGS. 6A and 6B show the difference of pressure within the ink cartridge 10 between the ink exchange time and the non-discharge type restoring time as described in the foregoing embodiment. In FIGS. 6A and 6B, the pump constituting the pressurizing means is driven at 1 and is stopped at 0. On the other hand, the air release valve which releases the high pressure state within the ink cartridge 10 is open at 1 and is closed at 0. Further, the pressure within the ink cartridge 10 to be detected by the pressure sensor is high at H and is low at 0.

In FIGS. 6A and 6B, the driven pump gradually increases the pressure within the ink cartridge 10 until driving of the pump is stopped after the passage of the preset time period. Thus, the pressure within the ink cartridge 10 is maintained at the pressure level at the time of the pump stoppage. The pressure at such time is the pressure delta Ps shown in the case of ink exchange which is higher than the pressure delta P0 shown in the case of non-discharge type restoring. This is because ink exchange is quickly effected under the high pressure within the ink cartridges 10 when the amount of discharged ink from the nozzles 6 is larger than the non-discharge type restoring time.

Figure 7:
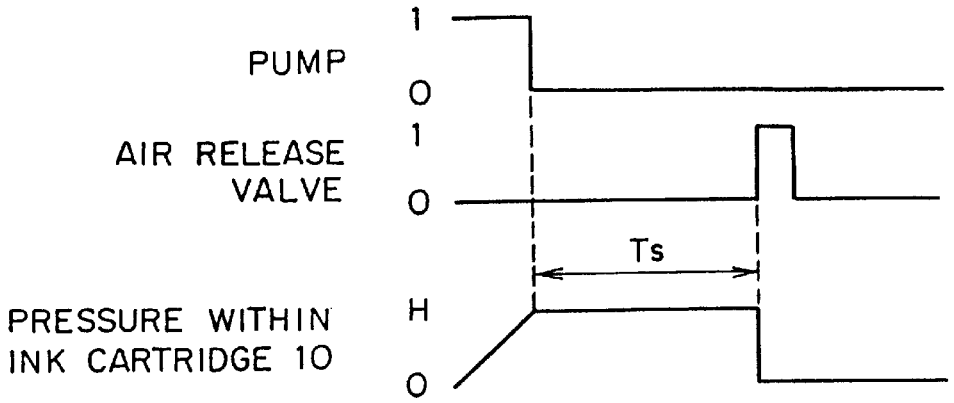
FIGS. 7A and 7B are time charts similar to FIGS. 6A and 6B showing the operations in ink exchange and non-discharge type respectively by another embodiment.
Figure 7:
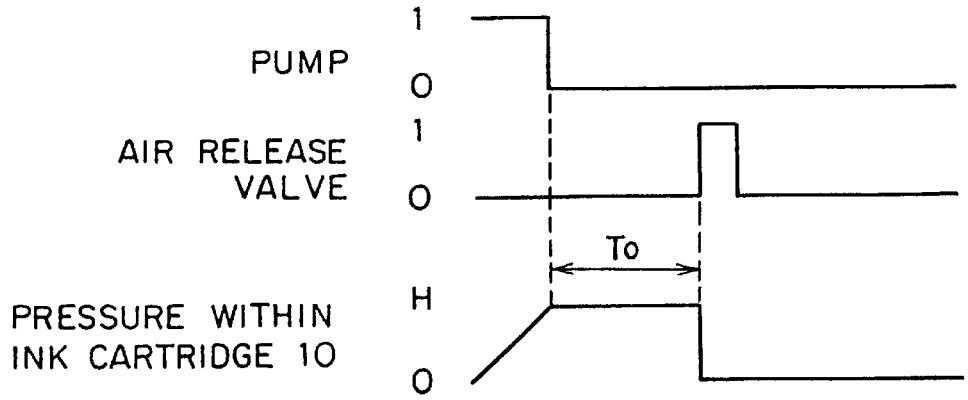

As shown in FIG. 7A, the time period from the stoppage of pump drive to the opening of the pressure release valve in the case of ink exchange is set at Ts which is longer than that set at T0 in the case of the non-discharge type restoring time such that the ink exchange is positively performed with the injection amount of ink from the nozzle being increased.

Further as shown in FIGS. 6A through 7B, it is possible to repeat the ink exchange operation a few times with the pressure within the ink cartridge 10 and the time period until the release valve is opened being set at the same level as in the case of the non-discharge type restoring time.

As explained heretofore, the embodiment of the present invention makes it possible to use plural types of ink as the case may be, it is capable of conduct a variety of printing operations corresponding to varying types of papers by means of the desired ink. Further, since the ink exchange is done by means of the pump unit 11 constituting the non-discharge type restoring mechanism, the need for a special ink exchange mechanism is eliminated thus making the structure simple. Further, since the theretofore filled ink is exchanged with the newly filled ink in a continuous manner, there is no bubble formation seen in the ink passages 17.

Figure 8:
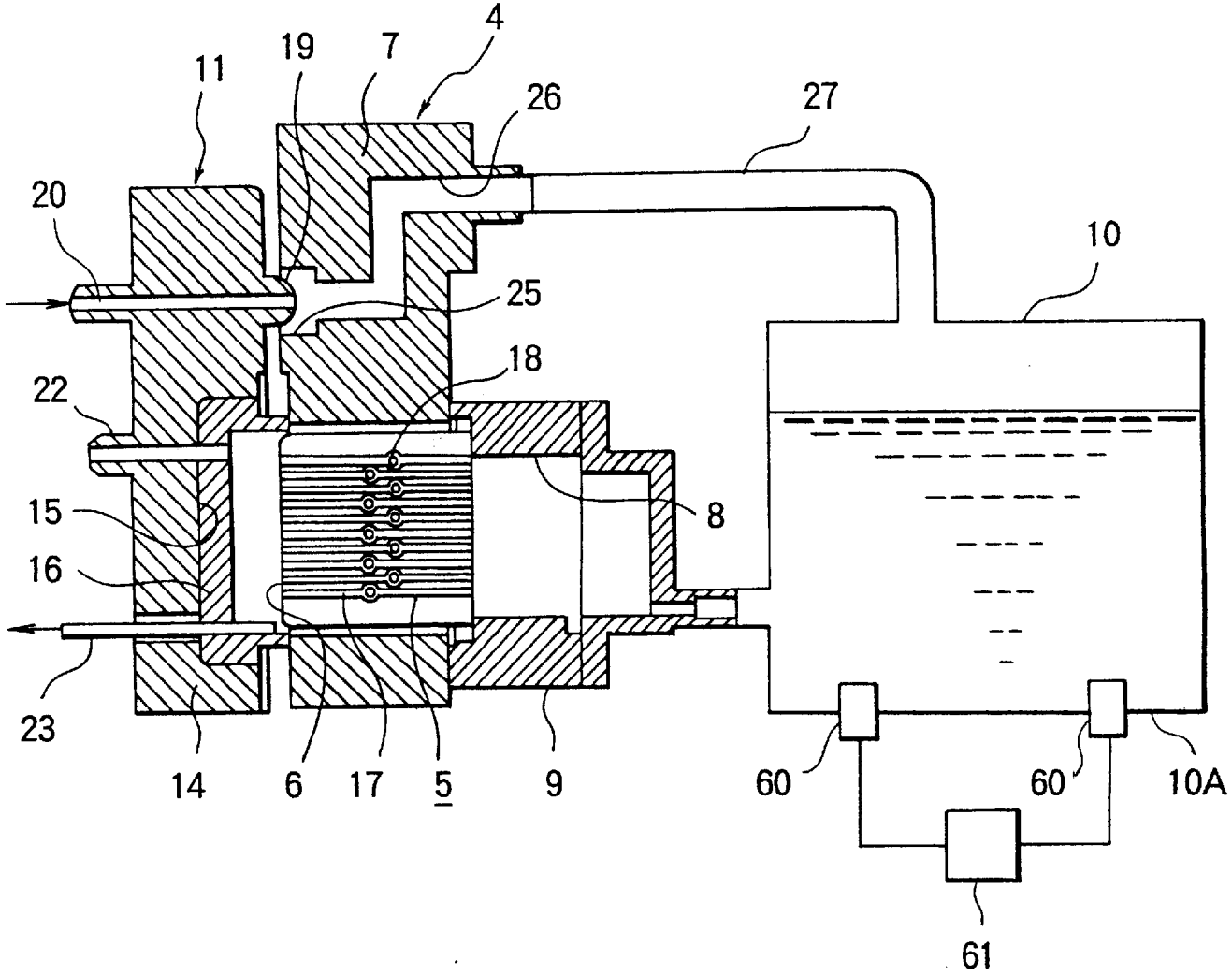
FIG. 8 is a view similar to FIG. 2 showing the embodiment provided with an ink type detection circuit.

Next, FIG. 8 shows another embodiment in which an ink type detection means for detecting the type of the filled ink on the basis of electrical conductivity is provided. In other words, a pair of electrodes 60 are arranged in the underside of the floor wall 10A of each ink cartridge 10 such that the upper portions of said pair of electrodes are kept in contact with the ink contained within the ink cartridges 10. Needless to say, there is no gap formed to allow any leakage of the ink between the floor wall 10A of the ink cartridges 10 and the respective electrodes 60. Further, said electrodes 60 are connected to the ink type detection circuit 61 constituting a ink type detection means, where the type of the ink contained within the ink cartridge 10 is detected by detecting the electrical conductivity of the ink between both electrodes 60. Then, the ink type detection circuit 61 is connected to the CPU board 47 shown in FIG. 5 to convey the ink type to the CPU board 47 in the form of electrical conductivity. Therefore, the CPU board 47 does the settings for the excitation conditions for said piezoelectric elements 18 in conformity with the type of ink inputted from said ink type detection circuit 61.

Thus constructed, the piezoelectric element 18 is automatically driven in accordance with the excitation condition corresponding to the ink type without the need for manual inputting of the ink type by an operator.

The present invention is not limited to the foregoing embodiments and allows modification as the case may be.

For example, the discharge element is not limited to the piezoelectric oscillator and may be in the form of a thermal head which may discharge ink from nozzles by raising the temperature of the ink in the ink cartridges.

Further, the ink exchange mechanism may be structured independently and separately from the non-discharge type restoring mechanism.

Further, the ink type detection means for automatically detecting the type of ink may be of the type which specifies the ink type by measuring the impedance property of the ink passage within the ink jet head and starting the printing action on the basis of such information. In other words, the discharge of ink from the ink jet heads generates vibration inherent to the ink passage, said vibration being determined by the shape of the passage or the passage wall forming the passage, the property of the material of the passage wall, the ink filling the inside of the passage. In other words, when the ink is exchanged, the vibration amplitude or vibration frequency varies with the result that it is possible to determine the type of ink by detecting the vibration using piezoelectric elements needed for ink discharge and processing the vibration in the waveform detection circuit to detect the amplitude change.

As explained heretofore, the present invention makes it possible to use plural types of ink as the case may be such that a variety of printings may be done in correspondence to the varying paper types through the use of the desired ink. Further, the use of the non-discharge type restoring mechanism as an ink exchange mechanism make the structure simple through an ink exchange operation without the need for a special ink exchange mechanism. Further, the continuous ink exchange from the theretofore filled ink to the newly filled ink make it possible to exchange ink without causing any formation of bubbles in the ink passages. Further, the provision of the ink type detection circuit makes it possible to drive the discharge element under the condition conforming to the ink type without the need for manual input of the ink type.

What is claimed is:

1. An ink jet printing device comprising:

a. an ink jet head having an ink passage therein with a leading end portion forming a nozzle;

b. filling means to fill said passage with ink;

c. a discharge element connected to said passage to discharge ink within said ink passage through said nozzle;

d. excitation control means for energizing said discharge element; and e. an ink exchange mechanism having a plurality of ink cartridges permitting said ink jet head to receive plural types of ink, including;

i. means for regenerating said ink jet head by admitting ink into said ink jet head and performing ink type switching by introducing a different type of ink rearwardly of the ink theretofore filled, said different types of ink having different electrical conductivities; and ii. an ink type detection means in said ink jet head for detecting said different type of ink according to electrical conductivity of the filled ink;

f. said excitation control means connected to said discharge element and said ink type detection means to actuate said discharge element in accordance with the type of filled ink detected by said ink type detection means.

* * * * *